US011767833B2

(12) United States Patent
Trinchieri et al.

(10) Patent No.: US 11,767,833 B2
(45) Date of Patent: Sep. 26, 2023

(54) SUPPORT SYSTEM FOR A DISPLACEMENT ADJUSTMENT PLATE OF AN AXIAL PISTON MACHINE

(71) Applicant: Dana Motion Systems Italia S.R.L., Reggio Emilia (IT)

(72) Inventors: Piergiorgio Trinchieri, Reggio Emilia (IT); Manuel Bezzi, Reggio Emilia (IT)

(73) Assignee: Dana Motion Systems Italia S.R.L., Reggio Emilia (IT)

( * ) Notice: Subject to any disclaimer, the term of this patent is extended or adjusted under 35 U.S.C. 154(b) by 0 days.

(21) Appl. No.: 17/658,337

(22) Filed: Apr. 7, 2022

(65) Prior Publication Data

US 2022/0325704 A1 Oct. 13, 2022

(30) Foreign Application Priority Data

Apr. 8, 2021 (DE) ..... 10 2021 203 462.4

(51) Int. Cl.
*F04B 1/2085* (2020.01)
*F01B 3/00* (2006.01)
*F03C 1/06* (2006.01)

(52) U.S. Cl.
CPC ..... *F04B 1/2085* (2013.01); *F01B 3/0073* (2013.01); *F03C 1/0671* (2013.01)

(58) Field of Classification Search
CPC ..... F01B 3/0073; F03C 1/0671; F04B 1/2085
See application file for complete search history.

(56) References Cited

U.S. PATENT DOCUMENTS 3,682,044 A * 8/1972 Ankeny ..... F01B 3/0032 91/487
4,543,876 A * 10/1985 Heyl ..... F04B 1/324 91/506
4,710,107 A * 12/1987 Kanies ..... F01B 3/0044 91/506
6,186,748 B1 2/2001 Umeda et al.
6,406,271 B1 6/2002 Valentin

FOREIGN PATENT DOCUMENTS

GB 2207198 A * 1/1989 ..... F01B 3/0035
WO WO-2009003922 A1 * 1/2009 ..... F01B 3/0073

* cited by examiner

*Primary Examiner* — Kenneth Bomberg
*Assistant Examiner* — Matthew Wiblin
(74) *Attorney, Agent, or Firm* — McCoy Russell LLP

(57) ABSTRACT

The present disclosure relates to an axial piston machine, such as a pump or motor. The axial piston machine, in on example, includes a pivotable displacement adjustment plate, the displacement adjustment plate having a first side supported by a first hydrostatic support arrangement and a second side supported by a second hydrostatic support arrangement. Further, in the axial piston machine one or both of the hydrostatic support arrangements include a large area support and a small area support which can be fluidly separated from each other.

11 Claims, 9 Drawing Sheets

H: high pressure
L: low pressure

H: high pressure
L: low pressure

SUPPORT SYSTEM FOR A DISPLACEMENT ADJUSTMENT PLATE OF AN AXIAL PISTON MACHINE

CROSS-REFERENCE TO RELATED APPLICATION

The present application claims priority to German Patent Application No. 10 2021 203 462.4, entitled "SUPPORT SYSTEM FOR A DISPLACEMENT ADJUSTMENT PLATE OF AN AXIAL PISTON MACHINE", and filed on Apr. 8, 2021. The entire contents of the above-listed application is hereby incorporated by reference for all purposes.

TECHNICAL FIELD

The present disclosure relates to hydraulic axial piston machines and may be applicable in the field of mechanical engineering, such as in the field of hydromechanical devices.

BACKGROUND & SUMMARY

Axial piston machines are generally known from previous systems. They may be used, for example, as axial piston motors or axial piston pumps. Both axial piston motors and axial piston pumps work according to the same principles, but in reversed modes. The present disclosure primarily describes axial piston pumps. However, it is understood that the working principle described herein may be equally applied in axial piston motors.

U.S. Pat. No. 3,682,044 A relates to a hydraulic axial piston pump which includes a housing and a rotating block rotating in the house, wherein the rotating block is driven by a pump drive via a shaft. Similarly, in a hydraulic motor, the rotating block is connected to a shaft and is driven by a high pressure fluid via multiple pistons. U.S. Pat. No. 3,682,044 A further discloses a hydrostatic bearing or support for a tilt plate functioning as a displacement adjustment plate for the pistons. For instance, according to U.S. Pat. No. 3,682,044 A this kind of a "cushion-like" bearing may counterbalance forces acting on the pistons and may reduce noise.

Usually, the cylinder block or rotating block of an axial piston machine is configured to rotate relative to a stationary valve plate. The fluid circulated by the pump then passes through different sections or openings of the stationary valve plate. The valve plate normally has an inlet fluid port and an outlet fluid port.

Typically, multiple pumping axial pistons protrude from the end of the cylinder block opposite the valve plate. The ends of the pistons slidingly bear against a displacement adjustment plate. The displacement adjustment plate or swashplate. When the displacement adjustment plate is oriented perpendicular to the rotation axis, the pistons do not move in the axial direction upon rotation of the cylinder block. Any inclination of the displacement adjustment plate with respect to the axial direction, however, causes the pistons to reciprocate in the axial direction upon rotation of the cylinder block, thereby allowing the pistons to provide a pumping action. In this manner, the valve plate controls the inlet and outlet of the operating fluid. An angle between a normal to the plane of the displacement adjustment plate and the axis of rotation determines the axial displacement of the pistons upon rotation of the cylinder block and the amount of fluid delivered by the pump during each revolution. The angle of the displacement adjustment plate may be variable by pivoting of the plate. In this way, the power provided by the pump may be controlled.

During the pumping action of an axial piston pump and during movement of an axial piston motor, the forces exerted on the pistons via the displacement adjustment plate are typically different from the forces exerted on the displacement adjustment plate via the pistons. For example, in the case of an axial piston pump, the forces acting on the pistons on the compression side of the displacement adjustment plate where the pistons force the operating fluid out of the cylinders are usually much bigger than the forces acting on the pistons on the suction side of the displacement adjustment plate where the pistons draw the operating fluid into the cylinders. Similarly, in an axial piston motor different forces act on the fluid feed side and on the fluid release side of the displacement adjustment plate.

U.S. Pat. No. 3,682,044 A relates to an axial piston pump having a displacement adjustment plate. A hydrostatic support of the displacement adjustment plate acts as a noise insulating cushion and counterbalances forces acting on the displacement adjustment plate.

U.S. Pat. No. 6,186,748 B1 relates an axial piston pump with several pistons rotating with a cylinder block and a valve plate for controlling the fluid flow from the rotating and reciprocating pistons.

U.S. Pat. No. 6,406,271 B1 relates to an axial piston pump with a rotating cylinder barrel wherein reciprocating movement is created by a tilted displacement adjustment plate and wherein a valve plate controls the flow of hydraulic fluid to and from the pistons and is designed to reduce pressure losses of the hydraulic fluid.

With respect to axial piston machines, it is generally known to use different hydrostatic supports for the two sides of a displacement adjustment plate. In this context, the term hydrostatic support may include a sliding hydrostatic support or a sliding bearing, for example.

In the case of an axial piston pump, the support on the high pressure/compression side of the displacement adjustment plate is designed to withstand a much bigger force than the support on the low pressure/suction side of the displacement adjustment plate. That is, in an axial piston pump the term high-pressure side or compression side of the displacement adjustment plate refers to the side of the plate where the pistons move to reduce the cylinder volume, thereby forcing operating fluid out of the cylinder or out of the cylinders, and the term low-pressure side or suction side of the displacement adjustment plate refers to the side of the plate where the pistons move to increase the cylinder volume, thereby drawing operating fluid into the cylinder or cylinders. By contrast, in an axial piston motor, the term high-pressure side or compression side of the displacement adjustment plate refers to the side of the plate where an externally applied pressure forces fluid into the cylinder, thereby driving the pistons to expand the cylinder volume, and the term low-pressure side refers to the side of the displacement adjustment plate where the pistons are driven to reduce the cylinder volume, thereby forcing fluid out of the cylinder. In the present disclosure, the two sides of the displacement adjustment plate may refer to two parts of the plate, for example two halves of the plate. For example, together the two halves of the plate may form a circular body part of the plate on which sockets or holders to which the pistons are connected may slide upon rotation of the cylinder block.

In the case of a machine that rotates in one direction a smaller hydrostatic support may be used on the low-pressure side of the plate, making it possible to save hydraulic fluid and to reduce the effort delivering large amounts of high-pressure fluid to all supports of the displacement adjustment plate.

However, such a solution is not applicable for bidirectional axial piston machines which may rotate in both directions of rotation. This is because in bidirectional axial piston machines, depending on the direction of rotation each of the supports on both sides of the machine may have to withstand high forces. Therefore, it is an object of the present disclosure to provide a system of hydrostatic supports for a bidirectional axial piston machine which may be operated with a reduced amount of hydraulic fluid.

It is another object of the present disclosure to develop a hydrostatic balancing system of the displacement adjustment plate supports that manages the displacement variation in axial piston pumps and in axial piston motors with unidirectional operation as well as in machines with bidirectional operation with an increased amount of pressurized fluid for hydrostatic supports or bearings.

Thus, in one example, an axial piston machine, such as a pump or a motor, is provided. Said machine includes a pivotable displacement adjustment plate which is supported by a first hydrostatic support arrangement on a first side and by a second hydrostatic support arrangement on a second side, wherein one or both of the hydrostatic support arrangements include a large area support and a small area support which can be fluidly separated from each other.

The pivotable displacement adjustment plate is typically pivotable about a pivot axis and has a support system with at least two support arrangements which may be located at different points on or near the pivot axis, for example at both ends of the plate near the pivot axis. Usually, each support arrangement includes one or more curved or arc-shaped or semi-circular or cylindrical support areas. Each of the support areas of the displacement adjustment plate may slide on a fixed support element which may have a correspondingly shaped area for receiving the support area of the displacement adjustment plate. In each of the support areas of the hydrostatic support arrangements, a pressurized fluid film may be provided which reduces friction between the displacement adjustment plate and the fixed support element.

The maximum force which can be balanced by each hydrostatic support arrangement depends on the fluid pressure and on the size of the support area. By combining for each working condition, for example for each direction of rotation of the machine, small and large support areas, and by providing the small and the large support areas on the same side of the displacement adjustment plate with different fluid pressures or with the same fluid pressure, the overall forces acting on the hydrostatic supports can be balanced or managed with a reduced amount of fluid in the hydrostatic supports. It is understood that a support area of the large area support or of each of the large area supports of the machine may be larger than a support area of the small area support or of each of the small area supports of the machine. Consequently, when provided with the same fluid pressure the large area support or each of the large area supports may counterbalance larger forces than the small area support or than each of the small area supports.

Both hydrostatic support arrangements may include at least a large area support. And depending on the rotation direction of the machine, in each of the hydrostatic support arrangements a large area support of one of the hydrostatic support arrangements may be connectable with a high-pressure fluid port while the respective large area support of the other support arrangement may connectable to a low-pressure fluid port. Further, where a small area support exists on one side, this small area support may be either fluidly connected to the large area support of the other side or to a high pressure fluid port.

Both hydrostatic support arrangements of the machine may include a large area support and a small area support. The large area support of the first hydrostatic support arrangement may then further be fluidly connected to the small area support of the second hydrostatic support arrangement. The terms first and second side of the displacement adjustment plate in this context should be understood such that along the pivot axis defined by the displacement adjustment plate, such as by the curved support areas of the displacement adjustment plate, the first and the second side of the displacement adjustment plate are located or disposed on opposite sides or at or near opposite ends of the displacement adjustment plate. In this implementation, the use of hydrostatic fluid may be reduced at least in one direction of rotation of the machine, in which the large area support of the side where the forces acting on the displacement adjustment plate are larger is provided with high-pressure fluid and the small area support on the opposite side is provided with the same fluid pressure. Additionally, the large area support of the second hydrostatic support arrangement may be fluidly connected to the small area support of the first hydrostatic support arrangement.

In this implementation, in each of the two directions of rotation of the machine, the large area support on the side of the displacement adjustment plate which has to withstand higher forces, say on the first side of the displacement adjustment plate, and the small area support on the other side of the displacement adjustment plate connected to it may be provided with a high pressure fluid, for example, it may be connected to a high pressure fluid port. At the same time, the large area support on the side of the displacement adjustment plate which has to withstand smaller forces, say on the second side of the displacement adjustment plate, and the small area support on the other side of the displacement adjustment plate connected to it may be provided with a low-pressure fluid, for example, it may be connected to a low-pressure fluid port. It is understood that a fluid pressure at the high-pressure fluid port is larger than a fluid pressure at the low-pressure fluid port. When the direction of rotation is reversed, the fluid connections of the large area supports to the high-pressure fluid port and to the low-pressure fluid port, respectively, may be reversed. In the case of an axial piston pump, the low-pressure port may be the suction port, and the high-pressure port may be the delivery port, for example. By contrast, in the case of an axial piston motor, the low-pressure port may be the fluid release port through which fluid is released from the motor, and the high-pressure port may be the feed port through which the high-pressure fluid driving the motor is fed into the motor, for example.

In an implementation of the presently proposed machine, the first side and the second side of the displacement adjustment plate are supported by a first hydrostatic support arrangement and by a second hydrostatic support arrangement, respectively, wherein both hydrostatic support arrangements include a large area support and a small area support, wherein each of the large area supports is fluidly connected to one fluid port of the machine in such a way that, at a given rotation direction of the machine, the large area support of the hydrostatic support arrangement on the side where the higher piston forces act on the displacement adjustment plate is connected to a high-pressure fluid port of the machine, while the large area support of the other hydrostatic support arrangement is fluidly connected to a low-pressure fluid port of the machine.

In an implementation of the presently proposed machine, the smaller area supports of the first and second hydrostatic support arrangements may each be connected to a high-pressure fluid port of the machine via a first one-way valve and to a low pressure fluid port of the machine via a second one-way valve, wherein the one-way valves are configured such that each of the small area supports is continuously fluidly connected to the fluid port with the higher-pressure. Again, it is understood that a fluid pressure at the high-pressure fluid port of the machine is larger than a fluid pressure at the low-pressure fluid port of the machine.

In case the presently proposed axial piston machine is an axial piston pump, the high-pressure fluid port may be identical to or fluidly connected to the fluid delivery port of the pump, and the low-pressure fluid port may be identical to or fluidly connected to the suction port of the pump. And in case the presently proposed axial piston machine is an axial piston motor, the high-pressure fluid port may be identical to or may be fluidly connected to the fluid pressure line which delivering fluid to the motor, and the low-pressure fluid port may be identical to or may be fluidly connected to the fluid pressure port leading fluid away from the motor.

With the axial piston machines described above, it may further be provided that at least one hydrostatic support arrangement on one side of the pivotable displacement adjustment plate includes a large area support in the form of a ring and a small area support which is located inside the ring.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

Exemplary embodiments of the presently proposed axial piston machine are described in the following detailed description and are depicted in the accompanying drawings.

DETAILED DESCRIPTION

Figure 1:
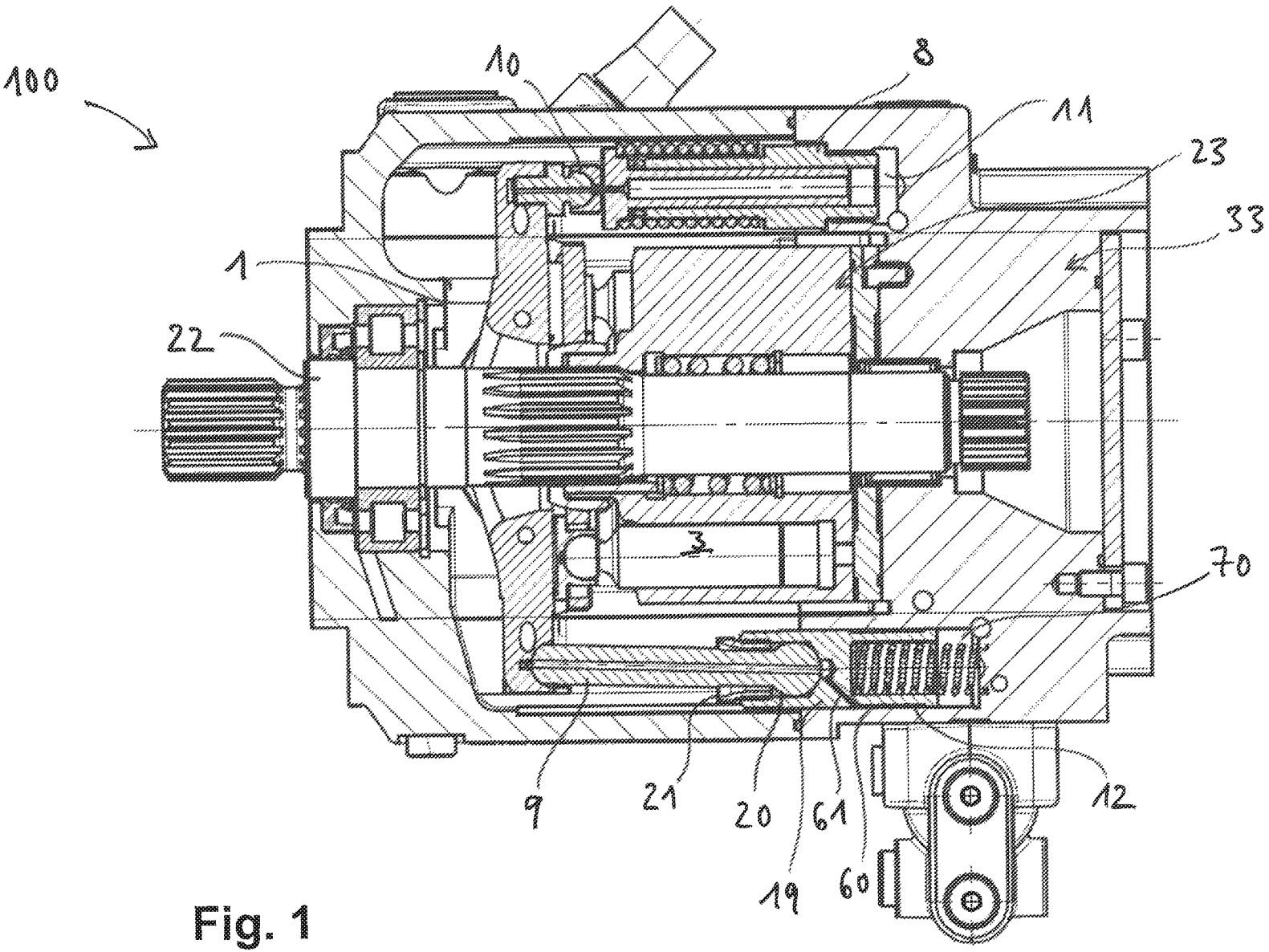
FIG. 1 schematically shows a sectional view of an axial piston machine of the presently proposed type including a pivotable displacement adjustment plate.
Figure 2:
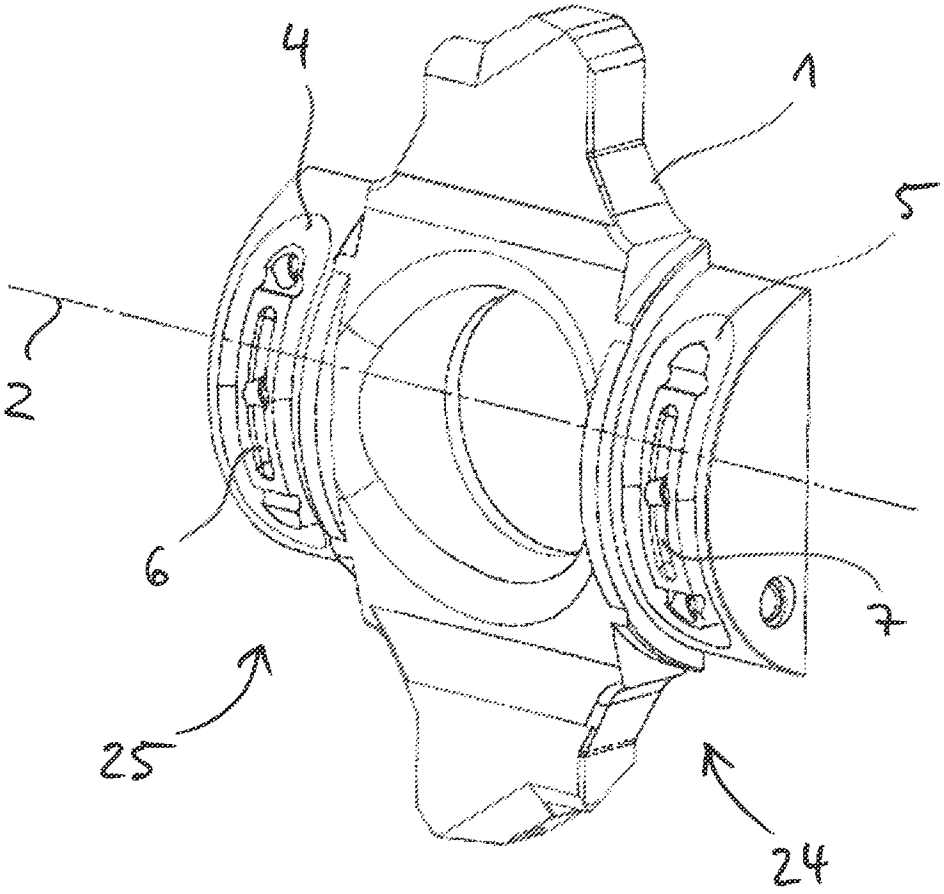
FIG. 2 schematically shows a detail of a displacement adjustment plate for an axial piston machine of the presently proposed type according to a first embodiment, the displacement adjustment plate including large area hydrostatic supports and small area hydrostatic supports on both sides of the plate.

FIG. 1 shows a cross-sectional view of an axial piston machine 100 of the presently proposed type such as an axial piston pump, such as a bidirectional axial piston pump. A displacement adjustment plate 1 of the machine 100 has two transversely aligned supports in the cross-sectional shape of a semicircle (not shown in FIG. 1). A displacement adjustment plate of the presently proposed type including such supports is shown in FIG. 2. Here and in all of the following recurring features depicted in different figures are designated with the same reference signs. The two support arrangements 4, 6 and 5, 7 on the two sides of the displacement adjustment plate 1 (left and right in FIG. 2) define or determine a pivot axis 2 of the plate 1. The pivot angle of the plate 1 determines the variation of the stroke of the pistons 3 and therefore of the pumping volume of each single piston and, thereby, the pumping power. As can be seen in FIG. 2, recesses are formed in the cylindrical or arc-shaped support surfaces of the displacement adjustment plate 1. These recesses may be filled with a pressurized fluid such as oil. The fluid may circulate between the support surfaces of the displacement adjustment plate 1 and corresponding counter-surfaces of a support element (not shown) which may be rigidly connected with a housing of the machine 100, for example. Together, the support surfaces of the displacement adjustment plate 1 and the counter-surfaces of the support element form hydrostatic bearings or hydrostatic support arrangements which provide lubrication to the support surfaces and which reduce friction between the support surfaces and the corresponding counter-surfaces of the support element.

FIG. 2 shows a displacement adjustment plate 1 where both hydrostatic support arrangements 4, 6 and 5, 7 disposed on opposite sides of the plate 1 along the pivot axis 2 include a first small push area or small area support 6, 7 and a second large push area or large area support 4, 5. For instance, FIG. 2 shows two oval or ring-shaped large area supports 4, 5 on the two sides 24, 25 of the plate 1 and two small area supports 6, 7. Here, the small area supports 6, 7 are disposed or located inside the ring-shaped large area supports 4, 5. The small area supports 6, 7 each cover a smaller area than each of the large area supports 4, 5. Each of the supports 4, 5, 6, 7 includes one or more recesses which are fluidly connected with channels configured to deliver a fluid such as oil to the supports 4, 5, 6, 7.

In the embodiment of FIG. 2, each of the small area supports 6, 7 on each of the two sides 24, 25 of the plate 1 may be fluidly disconnected or disconnectable from the large area support 4, 5 on the same side of the plate 1, respectively. In another embodiment, small and large area supports on the same side of the plate 1 may under certain conditions be fluidly connected or connectable to each other, for example by fluidly connecting both with a high pressure port of the machine.

In this way, on one or both sides 24, 25 of the plate 1, two supports may be provided with a high or low pressure fluid and their effect may be added or not based on a current operating condition, for example based on values of the forces exerted on each of the sides 24, 25 of the plate 1 by the rotating pistons. These forces typically depend on the pivot angle of the plate 1 with respect to the pivot axis 2, on the rotation speed of the pump and on the direction of rotation. Therefore, depending on the direction of rotation of the pump each of the supports on both sides 24, 25 of the plate 1 can be selectively fluidly connected with a high pressure fluid port or with a low pressure fluid port of the pump. For instance, the high pressure fluid port may be connectable or may be connected to the fluid delivery port of the pump, and the low pressure fluid port may be connectable or may be connected to the suction port of the pump. This solution allows for the connection of a first fluid port 11 of the machine to a first support and for the connection of a second fluid port 12 of the machine to a second support to select the large area support on the side of the pistons under pressure and the small area support on the side where the pistons are in a suction function, allowing to continually pressurize the correct support which counterbalances the forces of the pistons.

FIG. 1 illustrates that hydraulic fluid (e.g., oil) may be delivered to one or more area supports on one side or on both sides of the displacement adjustment plate 1 via a first fluid port 11 on the upper side of the machine 100, for example through a stationary adjustment piston 8 and through a joint 10 hinged on the displacement adjustment plate 1. And hydraulic fluid may be delivered to one or more area supports on the other side or on both sides of the displacement adjustment plate 1 via a second fluid port 12 of the machine 100 and through a stationary adjustment piston 9. Depending on a current mode of operation and on a rotation direction of the machine 100, each of the first and second fluid ports 11, 12 of the machine 100 may constitute a high pressure port or a low pressure port. Consequently, the large area and small area supports on selected sides of the displacement adjustment plate 1 may be selectively provided with high and low pressure fluid.

Figure 3:
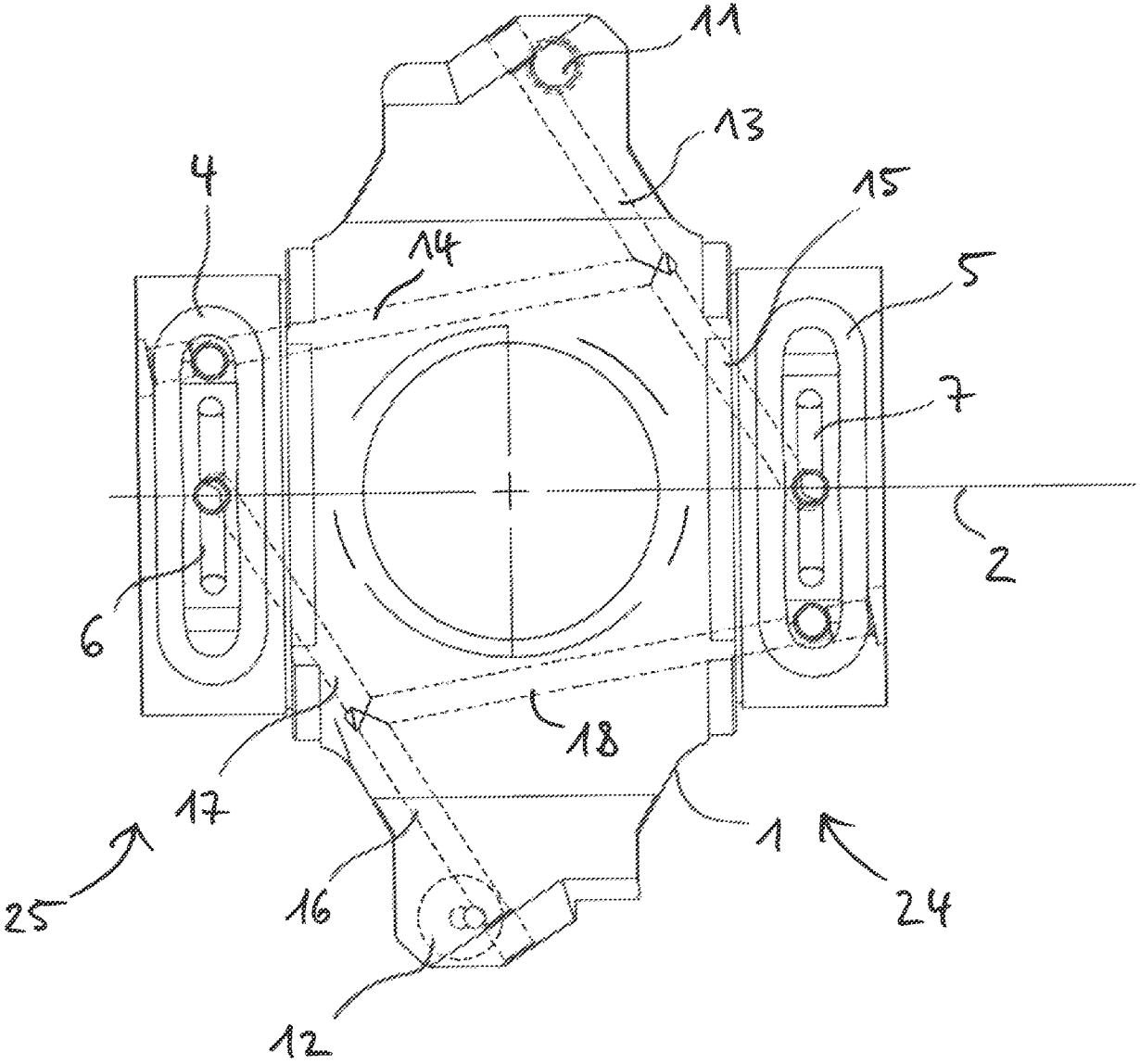
FIG. 3 schematically shows fluid connections of the support areas of the displacement adjustment plate of FIG. 2.

The embodiment of the machine 100 depicted in FIGS. 2, 3, 4 and 5 allows fluidly connecting the first fluid port 11 to the small area support 7 on the first side 24 of the plate 1 and to the large area support 4 on the second side 25 of the plate 1 via fluid channels 13, 14, 15 extending through the plate 1, and fluidly connecting the second fluid port 12 to the large area support 5 on the first side 24 of the plate 1 and to the small area support 6 on the second side 25 of the plate 1 via fluid channels 16, 17, 18 extending through the plate 1. In this manner, the large area support on the side of the plate 1 which has to withstand larger forces and the small area support on the side of the plate 1 subject to smaller forces may at all times be connected to the one of the fluid ports 11, 12 under high fluid pressure. For example, as shown in FIGS. 2 and 3, high pressure fluid from the first fluid port 11 may be delivered to the large area support 4 on the second side 25 of the plate 1 and to the small area support 7 on the first side 24 of the plate 1, for example via the stationary adjustment piston 8 and the joint 10 depicted in FIG. 1, and via the channels 13, 14, 15. And at the same time, low pressure fluid from the second fluid port 12 may be delivered to the large area support 5 on the first side 24 of the plate 1 and to the small area support 6 on the second side 25 of the plate 1, for example via the stationary adjustment piston 9 depicted in FIG. 1, and via the channels 16, 17, 18.

As shown in FIG. 1, the axial piston machine 100 may include a pilot chamber 70 and a pilot spool 19 received or at least partially received within the pilot chamber 70. The pilot spool 19 may be moved in parallel to the rotation axis of the machine by varying a hydrostatic pressure inside the pilot chamber 70, thereby actuating the displacement adjustment plate 1 and changing a pivot angle or tilt angle of the plate 1 with respect to the pivot axis 2 via the adjustment piston 9. In the machine 100 depicted in FIG. 1, the pilot spool 19 has recess or indentation 60 formed in a surface of the pilot spool 19 that extends parallel to the axis of rotation of the machine. The recess or indentation 60 may have an annular shape, for example. The recess or indentation 60 may form a chamber such as an annular chamber in between the spool 19 and a portion of a housing or casing of the machine 100, for example. The second fluid port 12 may be fluidly connected or connectable to one or more of the area supports 4, 5, 6, 7 of the plate 1 via the recess or indentation 60 formed in the surface of the pilot spool 19, via a channel 61 that extends through the pilot spool 19 and ends in the recess or indentation 60, and via a channel 61 that extends through the adjustment piston 9. The stationary adjustment piston 9 and the pilot spool 19 may be connected by means of a spherical joint 20 which may be locked by means of a threaded ring nut 21 and a sealing ring made of PTFE or bronze, for example. This solution allows reducing the leakage of oil under pressure and any detachment of the adjustment piston 9 from the pilot spool 19 during displacement variation phases.

Figure 4:
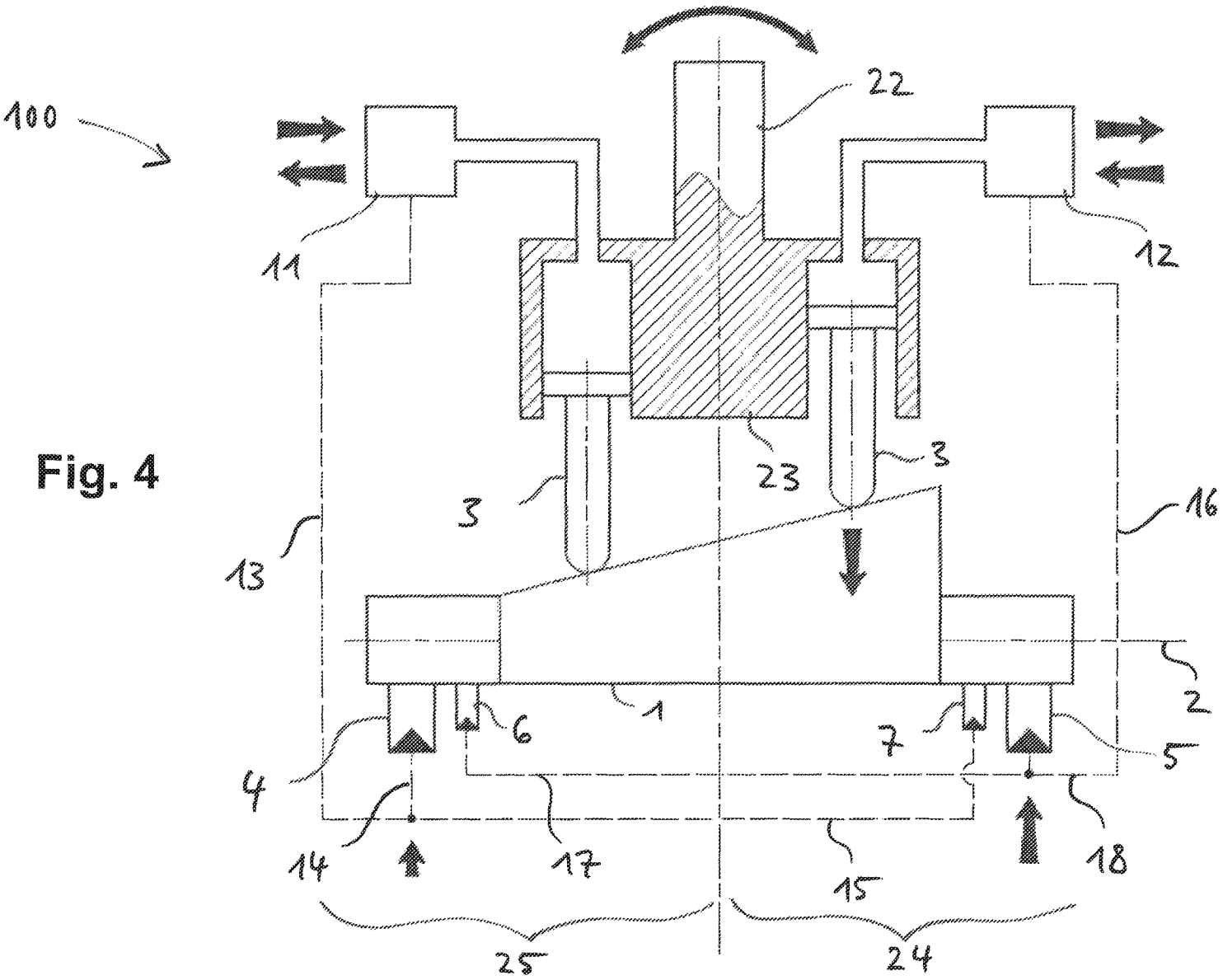
FIG. 4 schematically shows an axial piston machine of the presently proposed type including the displacement adjustment plate of FIGS. 2 and 3 and fluid connections between hydrostatic support arrangements of the plate and fluid ports of the machine.
Figure 5:
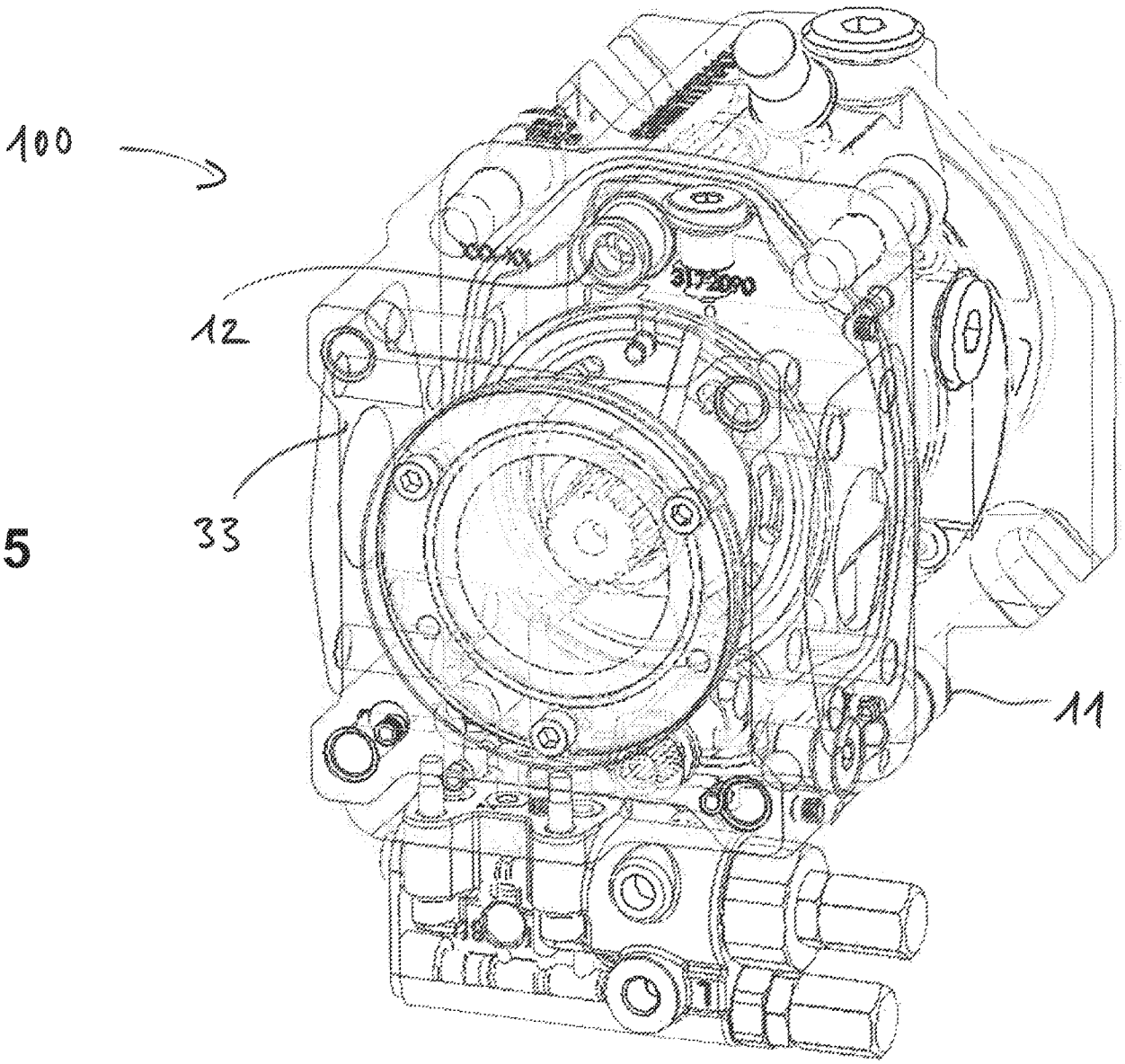
FIG. 5 schematically shows a 3-dimensional view of the axial piston machine of FIG. 1 in a transparent representation.

FIG. 4 schematically shows a schematic of the machine 100 of FIG. 1 including a shaft 22 which is fixedly connected to a barrel or cylinder block 23 in which the axial pistons 3 are configured to move back and forth when the barrel or cylinder block 23 rotates around a rotation axis defined by the shaft 22. Fluid channels 13, 14, 15 fluidly connect the large area support 4 on the second side 25 of the displacement adjustment plate 1 and the small area support 7 on the first side 24 of the displacement adjustment plate 1 with each other and with the first fluid port 11. And fluid channels 16, 17, 18 fluidly connect the large area support 5 on the first side 24 of the displacement adjustment plate 1 and the small area support 6 on the second side 25 of the displacement adjustment plate 1 with each other and with the second fluid port 12.

Depending on the direction of rotation of the machine 100, high fluid pressure may be selectively applied either to the large area support 5 on the first side 24 of the plate 1, or to the large area support 4 on the second side 25 of the plate 1. In FIG. 4, the inclined surface on the side of the plate 1 facing the barrel or cylinder block 23 schematically indicates the direction in which the pistons compress the cylinder volume and in which the forces exerted on the plate 1 increase, resulting in the delivery of high pressure fluid to the large area support 5 on the first side 24 of the plate 1 and to the small area support 6 on the second side 25 of the plate 1.

Figure 6:
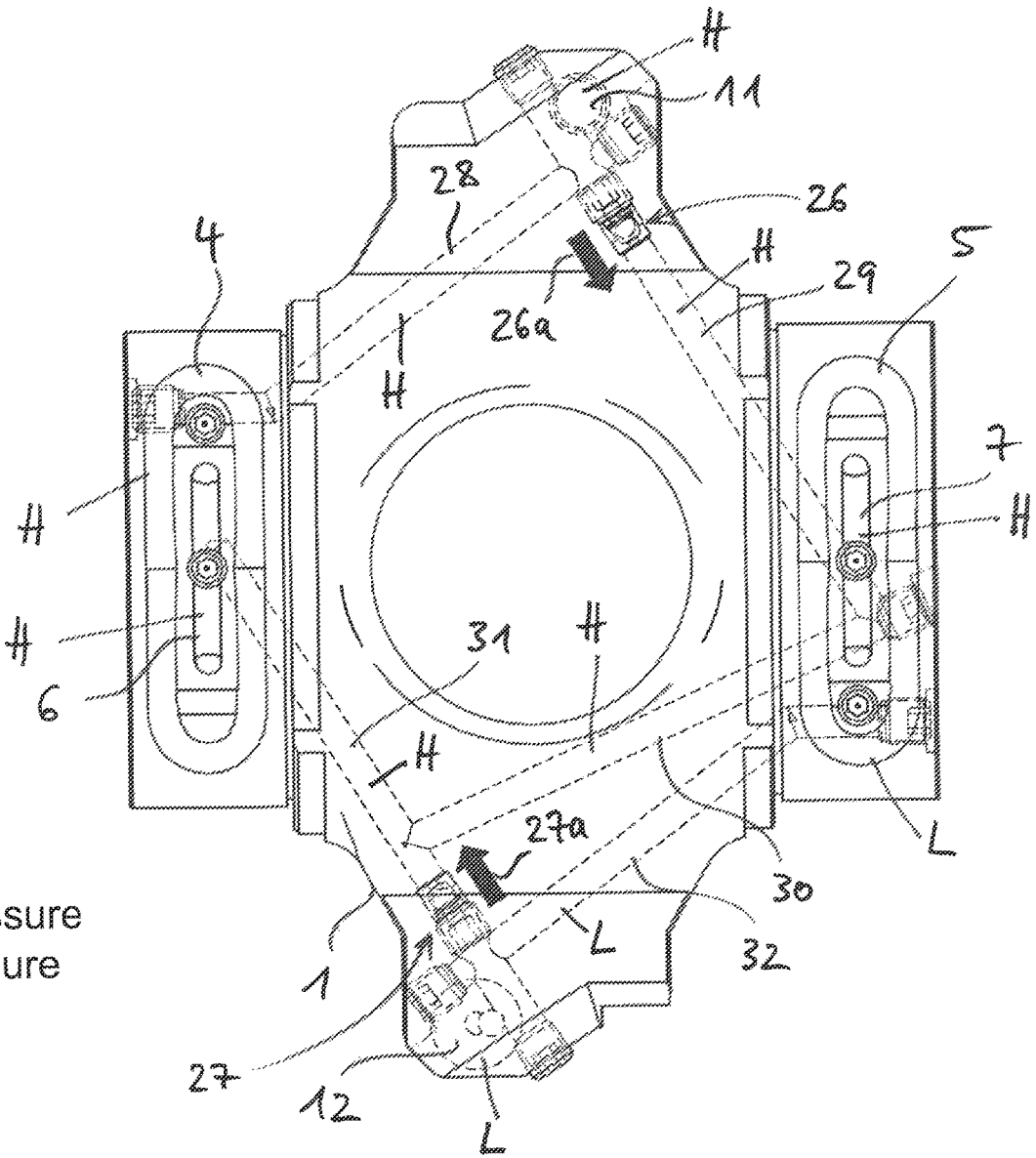
FIG. 6 schematically shows details of a displacement adjustment plate for an axial piston machine of the presently proposed type according to a second embodiment, with fluid connections between support areas of the plate and fluid ports of the machine as the machine rotates in a first rotational direction.
Figure 7:
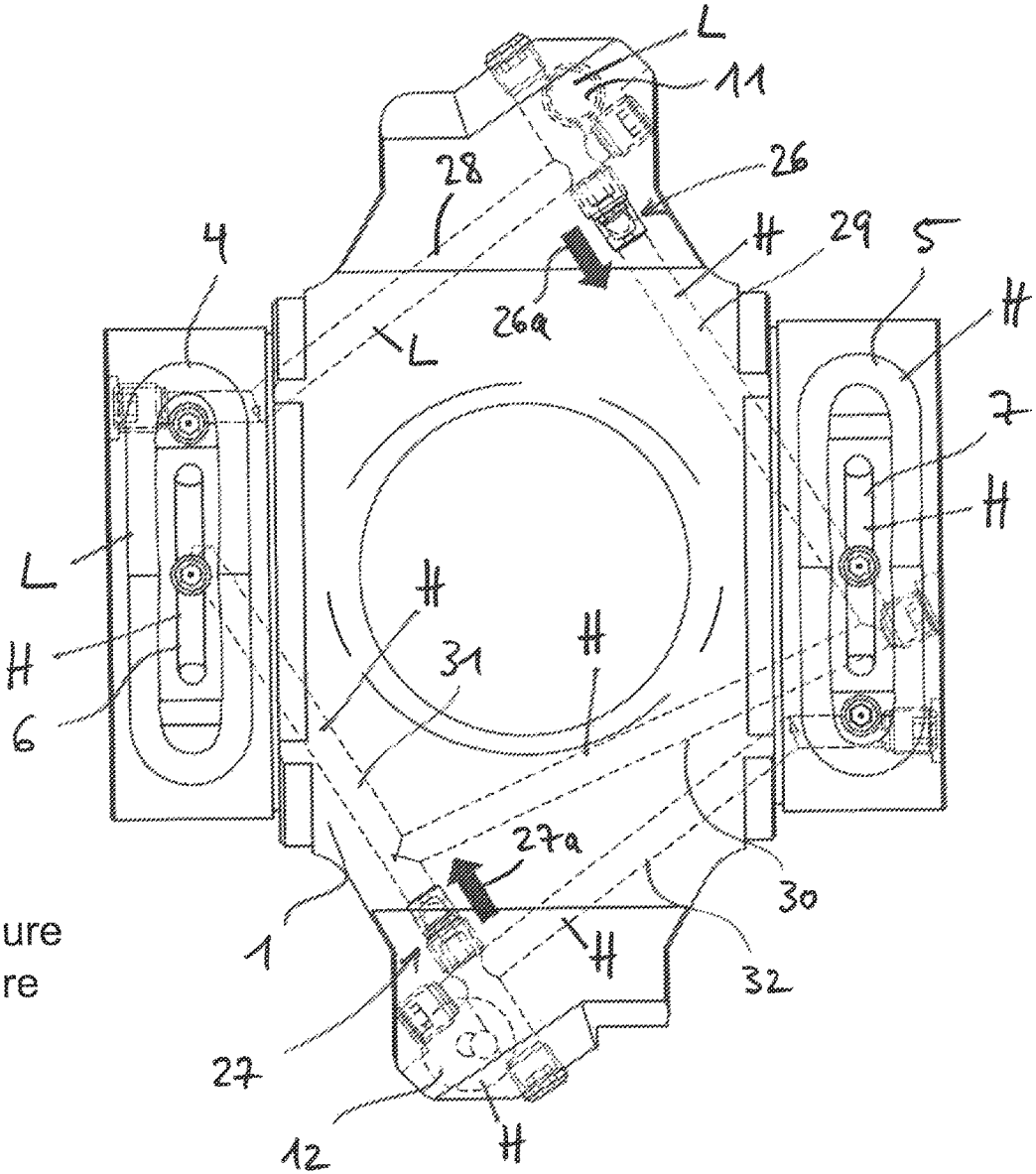
FIG. 7 schematically shows details of the displacement adjustment plate of FIG. 6 with fluid connections between support areas of the plate and fluid ports of the machine as the machine rotates in a second rotational direction.
Figure 8:
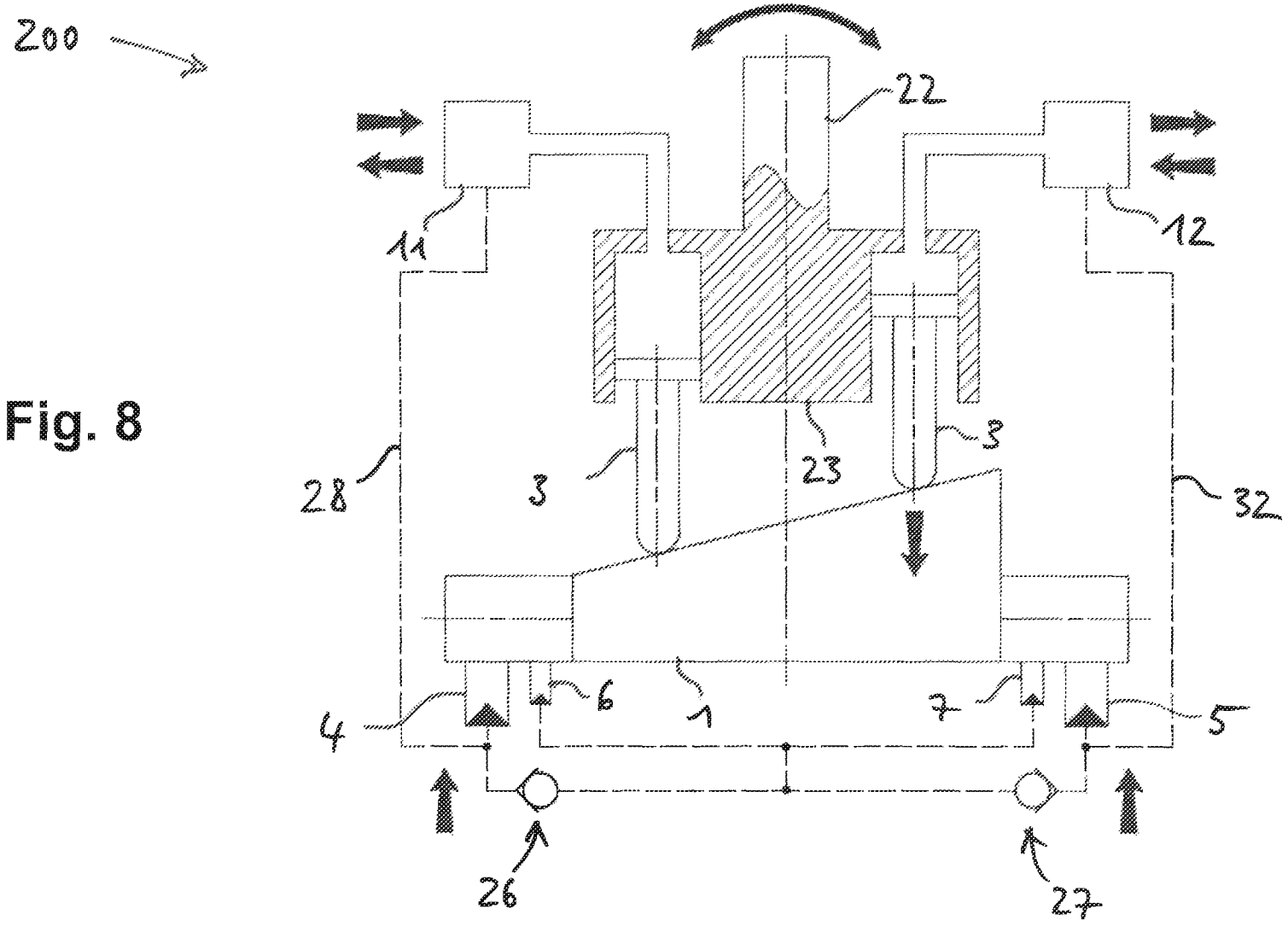
FIG. 8 schematically shows an axial piston machine of the presently proposed type including the displacement adjustment plate of FIGS. 6 and 7 and fluid connections between hydrostatic support arrangements of the plate and fluid ports of the machine.

FIGS. 6 and 7 depict another embodiment of the displacement adjustment plate 1 including two unidirectional or one-way valves 26, 27, and FIG. 8 shows a schematic of an axial piston machine 200 including the displacement adjustment plate 1 of FIGS. 6 and 7. The valves 26, 27 allow delivering high pressure fluid to a large area support on one side of the displacement adjustment plate 1 to counteract the intense forces exerted by the pistons on this side of the plate 1 and, at the same time, the valves 26, 27 allow delivering high pressure fluid to the small area support on the same side and to the small area support on the other side of the plate 1, while the large area support on the other side is provided only with a low pressure fluid. In FIGS. 6 and 7, arrows 26*a* and 27*a* designate the directions in which fluid can pass through the unidirectional valves 26, 27.

The plate 1 according to FIG. 6 includes a fluid channel 28 fluidly connecting the first fluid port 11 to the large area support 4, and a fluid channel 29 selectively fluidly connecting the first fluid port 11 to the small area support 7 via the one-way valve 26. The one-way valve 26 is configured to allow fluid to flow through the one-way valve 26 from the first fluid port 11 of the machine 200 to the small area support 7 and to block a flow of fluid through the one-way valve 26 from the small area support 7 to the first fluid port 11. The plate 1 according to FIG. 6 further includes a fluid channel 32 fluidly connecting the second fluid port 12 of the machine 200 to the large area support 5, and a fluid channel 31 selectively fluidly connecting the second fluid port 12 to the small area support 6 via the one-way valve 27. The one-way valve 27 is configured to allow fluid to flow through the one-way valve 27 from the second fluid port 12 to the small area support 6 and to block a flow of fluid through the one-way valve 27 from the small area support 6 to the second fluid port 12. The plate 1 according to FIG. 6 further includes a fluid channel 30 fluidly connecting or permanently fluidly connecting the small area supports 4 and 7 on opposing sides of the plate 1.

In FIG. 6, the first fluid port 11 functions as the high pressure fluid port of the machine 200 according to FIG. 8, and the second fluid port 12 functions as the low pressure fluid port of the machine 200 according to FIG. 8. In FIG. 6, high pressure fluid can flow from the first fluid port 11 to the large area support 4 via the channel 28, and to the small area support 7 via the valve 26 in the direction indicated at 26*a* and via the channel 29. From there, the high pressure fluid flows through the channels 30 and 31 to the small area support 6. The small area support 6 is located on the same side of the displacement adjustment plate 1 as the large area support 4. The flow from channel 30 to channel 32 and further to the second large area support 5 is blocked by the one-way valve 27. The large area support 5 is fluidly connected to the low pressure port 12 of the machine. In this way, the small area and large area supports 4, 6 on one side of the plate 1 are fluidly connected to the high pressure fluid port 11. On the other hand, the small area support 7 on the other side of the plate 1 fluidly connected to the high pressure fluid port 11 may guarantee the minimal support demanded for lubrication on the side of the plate 1 where the smaller piston forces are exerted.

In case the rotation direction of the machine (e.g., pump) is reversed, as shown in FIG. 7, the second fluid port 12 functions as the high pressure fluid port, and the first fluid port 11 functions as the low pressure fluid port. The high pressure second fluid port 12 delivers high pressure fluid to the small area support 6 via the one-way valve 27 and the channel 31, to the large area support 5 via the channel 32, and to the small area support 7 via the one-way valve 27 and the channel 30. Delivery of high pressure fluid to the other large area support 4 is blocked by the valve 26. The large area support 4 is fluidly connected to the low pressure port 11 via the channel 28. In this way, the small area and large area supports 5, 7 on one side of the plate 1 are fluidly connected to the high pressure fluid port 12. On the other hand, the small area support 6 on the other side of the plate 1 fluidly connected to the high pressure fluid port 12 may guarantee the minimal support demanded for lubrication on the side of the plate 1 where the smaller piston forces are exerted.

Figure 9:
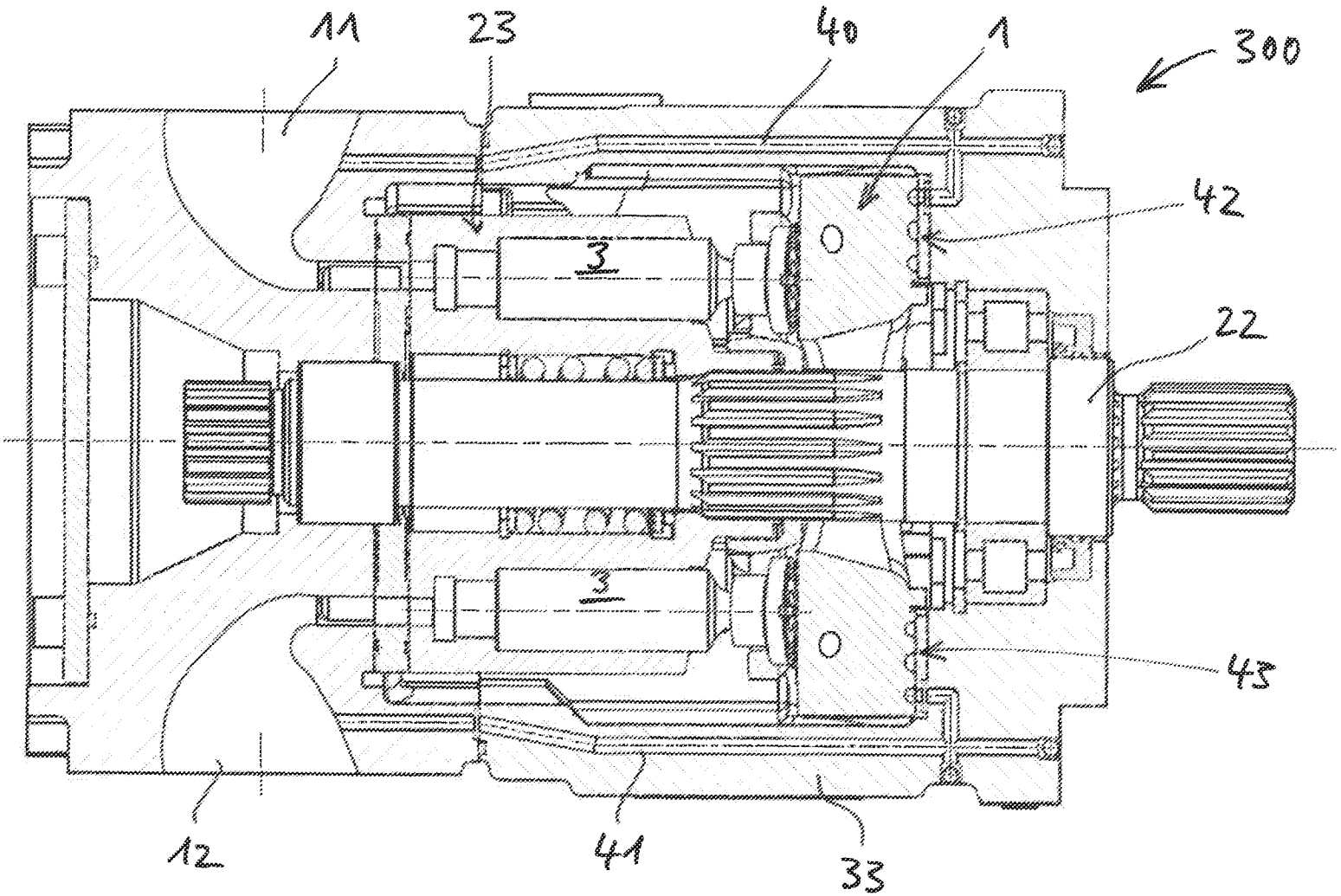
FIG. 9 schematically shows a further embodiment of an axial piston machine of the presently proposed type wherein fluid connections between fluid ports of the machine and the hydrostatic supports of the displacement adjustment plate extending through a casing of the machine.

FIG. 9 shows another axial piston machine 300 of the presently proposed type. The machine 300 includes fluid channels 40, 41 extending through a housing or casing 33 of the machine 300. The fluid channel 40 fluidly connects the first fluid port 11 with a first hydrostatic support arrangement 42 on a first side of the displacement adjustment plate 1, such as with a fixed bearing surface of the first hydrostatic support arrangement 42 on which the first side of the pivotable plate 1 is supported and which may be rigidly connected to the housing or casing 33. And the fluid channel 41 fluidly connects the second fluid port 12 with a second hydrostatic support arrangement 43 on a second side of the displacement adjustment plate 1 opposite the first side, such as with a fixed bearing surface of the second hydrostatic support arrangement 43 on which the second side of the pivotable plate 1 is supported and which may be rigidly connected to the housing or casing 33.

FIGS. 1-9 show example configurations with relative positioning of the various components. Further, FIGS. 1-3, 5-7, and 9 are drawn approximately to scale, although other relative component dimensions may be used, in other embodiments. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Throughout this specification relative language such as the words "approximately" may be used. Unless otherwise specified or described, this language seeks to incorporate at least 5% variability to the specified number or range. That variability may be plus 5% or negative 5% of the particular number specified.

The foregoing description is considered as illustrative only of the principles of the described embodiments. Further, since numerous modifications and changes will readily occur to those skilled in the art, it is not desired to limit the described embodiments to the exact construction and processes shown and described herein. Accordingly, all suitable modifications and equivalents may be considered as falling within the scope of the described embodiments as defined by the claims which follow.

The invention claimed is:

1. An axial piston machine comprising:

a pivotable displacement adjustment plate;

wherein the pivotable displacement adjustment plate includes a first side supported by a first hydrostatic support arrangement and a second side supported by a second hydrostatic support arrangement;

wherein one or both of the first and second hydrostatic support arrangements include a large area support and a small area support which can be fluidly separated from each other; and wherein at least one of the first and second hydrostatic support arrangements on one side of the pivotable displacement adjustment plate includes the large area support in the form of a ring and the small area support which is located inside the ring.

2. The axial piston machine of claim 1, wherein both of the first and second hydrostatic support arrangements include at least the large area support and wherein, depending on a rotation direction of the axial piston machine, in each of the first and second hydrostatic support arrangements the large area support of one of the first and second hydrostatic support arrangements is connectable or connected with a high pressure fluid port, while the large area support of the other support arrangement is connectable or connected to a low pressure fluid port, and wherein, where the small area support exists on one side, it is either fluidly connected to the large area support of the other side or to the high pressure fluid port.

3. The axial piston machine of claim 1, wherein the pivotable displacement adjustment plate on its first side and on its second side is supported on the first and second hydrostatic support arrangements, wherein both the first and second hydrostatic support arrangements include the large area support and the small area support, wherein the large area support of the first hydrostatic support arrangement is fluidly connected to the small area support of the second hydrostatic support arrangement.

4. The axial piston machine of claim 3, wherein the large area support of the second hydrostatic support arrangement is fluidly connected to the small area support of the first hydrostatic support arrangement.

5. The axial piston machine of claim 1, wherein both hydrostatic support arrangements include the large area support and the small area support and wherein the large area support in the first hydrostatic support arrangement is connected with a high pressure fluid port while the respective large area support of the second hydrostatic support arrangement is connected to a low pressure fluid port when the axial piston machine is rotated in one of two rotational directions.

6. The axial piston machine of claim 1, wherein:

the pivotable displacement adjustment plate on its first side is supported by the first hydrostatic support arrangement and on its second side is supported by the second hydrostatic support arrangement; and both the first and second hydrostatic support arrangements include the large area support and the small area support.

7. The axial piston machine of claim 6, wherein the smaller area supports of the first and second hydrostatic support arrangements are each connected through a fluid channel with both a high pressure fluid port and a low pressure fluid port of the axial piston machine via two one way valves, wherein the two one way valves are configured such that each of the small area supports is continuously fluidly connected with the high pressure fluid port.

8. The axial piston machine of claim 6, wherein the fluid pressure in the low pressure fluid port is smaller than the fluid pressure in the high pressure fluid port.

9. The axial piston machine of claim 1, wherein in case the axial piston machine is a pump, a high pressure fluid port is connected to a fluid delivery port of the pump and in case the axial piston machine is a motor, the high pressure fluid port is connected to a fluid pressure line which is delivering fluid to the motor.

10. The axial piston machine of claim 1, wherein the axial piston machine is a pump and a low pressure fluid port is connected to a fluid suction port of the pump.

11. The axial piston machine of claim 1, wherein the axial piston machine is a motor and a low pressure fluid port is connected to a fluid pressure port which is leading fluid away from the motor.

* * * * *